US010456327B2

(12) United States Patent
Robertson

(10) Patent No.: US 10,456,327 B2
(45) Date of Patent: Oct. 29, 2019

(54) PACKAGE FOR FROZEN NUTRIENT PILL

(71) Applicant: Craig Robertson, Thousand Oaks, CA (US)

(72) Inventor: Craig Robertson, Thousand Oaks, CA (US)

( * ) Notice: Subject to any disclaimer, the term of this patent is extended or adjusted under 35 U.S.C. 154(b) by 123 days.

(21) Appl. No.: 15/240,392

(22) Filed: Aug. 18, 2016

(65) Prior Publication Data

US 2017/0056287 A1 Mar. 2, 2017

Related U.S. Application Data

(60) Provisional application No. 62/176,910, filed on Aug. 28, 2015, provisional application No. 62/247,605, filed on Oct. 28, 2015.

(51) Int. Cl.

| | |
|---|---|
| ***A61J 1/03*** | (2006.01) |
| ***B65B 47/00*** | (2006.01) |
| ***B65B 63/08*** | (2006.01) |
| ***B65B 3/04*** | (2006.01) |
| ***B65D 75/36*** | (2006.01) |

(52) U.S. Cl.

CPC ..... *A61J 1/035* (2013.01); *B65B 3/04* (2013.01); *B65B 47/00* (2013.01); *B65B 63/08* (2013.01); *B65D 75/367* (2013.01); *B65D 2575/367* (2013.01)

(58) Field of Classification Search

CPC . A23P 30/00; A23P 30/10; A23G 1/20; A23G 1/22; A23G 1/202; A23G 1/0236; A23G 3/0242; B65B 3/04; B65B 63/08; B65D 2575/367; B65D 75/367; B65D 75/36; A61J 1/035

USPC ..... 249/119, 127, 129, 130; D9/732, 431

See application file for complete search history.

(56) References Cited

U.S. PATENT DOCUMENTS

| | | | | |
|---|---|---|---|---|
| 139,858 A | | 6/1873 | Blackman | |
| 1,285,958 A | * | 11/1918 | Eckford | B22C 9/06 249/110 |
| 1,689,357 A | * | 10/1928 | Merrell | A23C 9/18 249/126 |
| 1,705,328 A | * | 3/1929 | Griffith | A23G 1/21 249/120 |
| 1,793,263 A | * | 2/1931 | Trop | A23G 3/0263 249/134 |
| 1,843,306 A | * | 2/1932 | William | A23G 1/22 249/120 |

(Continued)

*Primary Examiner* — Joseph S Del Sole
*Assistant Examiner* — Emmanuel S Luk
(74) *Attorney, Agent, or Firm* — James Conte

(57) ABSTRACT

A package has a plurality of seamless compartments coupled together. A different one of the plurality compartments each includes a different respective one of a plurality of respective void spaces and a different respective one of a plurality of respective void space delimiting surfaces. A different one of a plurality of fill entries each forms a fluent entry into a different respective compartment's void space. At least one fill entry of said plurality is in an elastomeric portion of said package, and the at least one fill entry has a largest cross sectional area which is equal to or less than 25% of a largest cross sectional area of the compartment having the respective void space for which the fill entry forms the fluent entry. Each void space delimiting surface follows an outline of a separate 3D pill shape.

12 Claims, 9 Drawing Sheets

(56) References Cited

U.S. PATENT DOCUMENTS 1,879,602 A * 9/1932 Copeman ..... F25C 1/24 249/127
1,948,147 A * 2/1934 Warren ..... A23G 9/221 249/119
2,015,496 A 9/1935 Platt
2,053,711 A * 9/1936 Glomb ..... A23G 9/221 249/120
2,083,081 A * 6/1937 Moll ..... A23G 9/083 249/120
D125,151 S 2/1941 Fagan
2,287,270 A * 6/1942 Partridge ..... B29C 33/60 106/243
2,433,211 A * 12/1947 Gits ..... A23G 9/221 206/551
2,493,854 A * 1/1950 Frederica ..... A21C 11/106 249/112
2,552,027 A * 5/1951 Bird ..... A61J 3/06 249/134
2,592,232 A * 4/1952 Marks ..... A23G 3/0273 249/127
2,704,927 A * 3/1955 Carrell ..... F25C 1/24 249/119
2,718,126 A * 9/1955 Ball ..... A61C 19/00 249/127
2,890,122 A * 6/1959 Katon ..... B65D 1/36 229/406
2,932,386 A * 4/1960 Meyer ..... A61J 3/08 206/529
3,021,695 A * 2/1962 Voigtmann ..... F25C 1/243 249/127
3,039,246 A 6/1962 David
3,103,774 A * 9/1963 Wall ..... B65B 15/02 206/445
3,120,112 A * 2/1964 Davis ..... F25C 1/243 249/127
3,159,985 A * 12/1964 Keighley ..... F25C 1/243 249/127
D202,529 S 10/1965 Rosebrook
3,214,128 A * 10/1965 Beck ..... F25C 1/243 249/127
3,412,572 A * 11/1968 Kesling ..... F25C 1/243 249/120
3,429,426 A * 2/1969 Weller ..... B65D 75/327 206/531
3,443,785 A * 5/1969 Ewers ..... F25C 1/243 249/121
3,483,908 A * 12/1969 Donovan ..... B65D 1/34 206/526
3,588,029 A * 6/1971 Hinds ..... A23P 30/10 249/119
3,676,897 A * 7/1972 Bianco ..... A22C 7/0015 249/108
3,844,525 A * 10/1974 Parmett ..... F25C 1/243 220/23.8
4,147,324 A * 4/1979 Walter ..... B44C 5/06 249/121
4,148,457 A * 4/1979 Gurbin ..... F25C 1/243 249/127
4,223,043 A * 9/1980 Johnson ..... A23G 9/221 206/820
4,426,002 A * 1/1984 Rez ..... B65D 85/00 126/400
4,812,323 A * 3/1989 Savage ..... A21D 13/33 249/122
4,813,646 A * 3/1989 Fujio ..... A23G 9/221 249/127
4,887,790 A * 12/1989 Wilkinson ..... A61J 3/06 206/531
4,901,858 A * 2/1990 Anderson ..... B29C 51/04 206/461
4,915,231 A * 4/1990 Perbet ..... B65D 75/30 206/461
5,088,598 A * 2/1992 Iguchi ..... G09B 25/00 206/223
5,431,915 A 7/1995 Harvey et al.
5,560,490 A * 10/1996 Chawla ..... B65D 75/327 206/471
5,613,609 A * 3/1997 Hamilton ..... A61J 1/035 206/531
5,769,228 A * 6/1998 Wroblewski ..... B65D 75/36 206/461
D408,278 S * 4/1999 Konop ..... D9/415
D424,807 S * 5/2000 Dembicks ..... D3/201
6,258,384 B1 7/2001 Stanley et al.
D450,186 S * 11/2001 Dembicks ..... D3/313
D450,454 S * 11/2001 Dembicks ..... D3/313
D452,077 S * 12/2001 Dembicks ..... D3/313
D457,788 S 5/2002 Hornsby, IV
6,427,841 B2 * 8/2002 Wani ..... B65D 75/36 206/471
6,588,180 B2 * 7/2003 Heath ..... B65B 47/04 206/531
6,627,239 B1 * 9/2003 Gavie ..... A21B 3/131 249/119
7,202,087 B2 4/2007 Herslof et al.
D560,695 S 1/2008 Marchionda
7,387,206 B2 * 6/2008 Grosskopf ..... A61J 1/035 206/468
8,794,482 B2 * 8/2014 Sack ..... A61J 7/0076 221/268
9,566,362 B1 * 2/2017 Hanna ..... A61L 9/02
2002/0005468 A1 * 1/2002 Fraenkel ..... A23G 9/083 249/127
2003/0047838 A1 * 3/2003 Beale ..... A21B 3/131 264/328.1
2003/0141431 A1 * 7/2003 Lopes ..... F25C 1/24 249/119
2003/0152659 A1 * 8/2003 McCloskey ..... A23G 3/0257 425/256
2004/0075038 A1 * 4/2004 Hang ..... F25C 1/243 249/127
2004/0124561 A1 * 7/2004 An ..... C11D 13/16 264/334
2005/0151049 A1 * 7/2005 Lion ..... F25C 1/24 249/121
2005/0151050 A1 * 7/2005 Godfrey ..... F25C 1/24 249/127
2005/0181042 A1 8/2005 Herslof
2006/0131784 A1 * 6/2006 Sugimoto ..... B29C 33/40 264/293
2008/0122139 A1 * 5/2008 Thomassen ..... B29C 33/0055 264/334
2008/0124286 A1 5/2008 Lisson
2008/0245800 A1 10/2008 Moore
2009/0008529 A1 * 1/2009 Sugimoto ..... B29C 33/3857 249/127
2010/0015184 A1 1/2010 Tuel
2010/0316736 A1 12/2010 Aharon
2012/0145879 A1 * 6/2012 Verma ..... F25C 1/243 249/119
2013/0341820 A1 * 12/2013 Laycock ..... A61F 2/28 264/109
2014/0079860 A1 3/2014 Ho

* cited by examiner

PACKAGE FOR FROZEN NUTRIENT PILL

FIELD

The present disclosure concerns a package having an array of compartments each of which receives a fluent material which is later frozen while in the compartment.

BACKGROUND

US patent publication 2008/245,800, Disposable Container For Frozen Liquid, Moore, discloses that each of a plurality of silicone rubber molds is covered by a holder structure which has a flanged body. A handle extends from one side of the body, and an anchor structure extends from the other side of the body into the interior of the mold. The anchor structure has an enlarged outer end which engages with and tends to hold the frozen confection onto the handle for removal from the mold, and while the confection is being eaten.

US patent publication, 2014/0079860, Frozen Confection Device and Method, Ho, discloses a container having individually sealed container cells that store liquid that may be frozen into a shape suitable for inserting the frozen article into a bottle or can. The container cells may be individually detachable for convenient use and may be constructed from an inexpensive and disposable material. The container cells may store purified water and/or a combination of various types of liquids.

U.S. Pat. No. 3,039,246, Suppository Package and Method of Making, David, discloses packaging material that is initially fluent or capable of flowing and thereafter hardens, and more especially a package which includes opposed layers of relatively thin packaging material such as aluminum foil, sealed together in certain zones which form the boundaries of a compartment or chamber between said layers in which is deposited the material being packaged. Two layers of the packaging material are initially sealed together to partially form a compartment between them having an open end through which the material being packaged is inserted into the compartment and thereafter the layers are sealed together to close said open end; completing the compartment with the material therein, and the layers can thereafter be easily and quickly separated for removal of the material from the compartment.

SUMMARY

One example of the invention is embodied by a package having a plurality of seamless compartments, the plurality of compartments are coupled together. The plurality of compartments comprise a plurality of respective void spaces and a plurality of respective void space delimiting surfaces. Each compartment includes a different one of said respective void spaces and includes a different one of said respective void space delimiting surfaces. A different compartment of said plurality forms part of a different one of a plurality of receptacles. The package further has a plurality of fill entries. A different one of said plurality of fill entries each form a fluent entry into a respective void space of a different one of said compartments. At least one fill entry of said plurality is in an elastomeric portion of said packaging and said at least one fill entry has a width measured along its minor axis or a diameter which is equal to or less than 85% of the width of its respective compartment wherein the width of the compartment is measured along the compartment's minor axis. Also the at least one fill entry has a length measured along its major axis that is equal to or less than 95% of the length of the respective compartment wherein the length is measured along the compartment's major axis. The percentages pertain to a package made from a thin form process as described herein. The percentages for the width or diameter could be much less such as less than or equal to 25%. The percentages for the length could be much less such as less than or equal to 85%. The percentage for the width could be as little as 0% if the fill entry has a normally closed position. The percentages for the width could be equal to or less than 7% for a package made from a thick form process. Each compartment delimits a volume, which is the volume of the compartment's void space, which is from 0.7 ml to 4 ml. Each void space delimiting surface follows an outline of a separate 3D pill shape.

One example of a method embodying the invention comprises providing a package which includes a plurality of compartments coupled together; the compartments form a plurality of respective void spaces and a plurality of respective void space delimiting surfaces. A different one of each compartment of said plurality includes a different one of said respective void spaces and includes a different one of said respective void space delimiting surfaces. Each compartment forms part of a different one of a plurality of receptacles. The package provided further has a plurality of fill entries. A different one of said plurality of fill entries each forms a fluent entry into a void space of a different one of said compartments. At least one fill entry has a width measured along its minor axis or a diameter which is equal to or less than 85% of the width of its respective compartment, wherein the width of the compartment is measured along the compartment's minor axis. Also the at least one fill entry has a length measured along its major axis that is equal to or less than 95% of the length of the respective compartment wherein the length is measured along the compartment's major axis. The percentages for the width or diameter could be much less such as less than or equal to 25%. It could be as little as 0% if the fill entry has a normally closed position. The percentages for the length could be less than or equal to 85%. Each compartment's void space has a volume from 0.7 ml to 4 ml. Each void space delimiting surface follows an outline of a separate 3D pill shape.

Once the package is provided, fluent is flowed into each of said plurality of compartments' void spaces through the compartment's respective fill entry.

One example of a method of making the package includes providing a form. The form is preferably a vacuum enabled form. The form provides a negative of the shape of the package to be formed. The form includes a plurality of pill compartment forming portions; each following an outline of a pill. The form also includes a support. The support carries the plurality of the pill compartment forming portions. Each pill compartment forming portion is carried by the support. The method further includes contacting a thin elastic sheet preferably made from Ethylene Vinyl Acetate (EVA), silicone or rubber to the support and pill forming portions. The method further includes forming a plurality of receptacles coupled to a support from the thin elastic sheet with negative pressure when the sheet is in contact with the support and pill compartment forming portions; the forming step further includes forming a plurality of compartments from the sheet, a different compartment of said plurality each having a different respective void space and a different respective void space delimiting surface; a different compartment of said plurality each forming part of a different respective one of said receptacles. The forming step further includes forming a plurality of fill entries from the sheet; a different fill entry of said plurality opens into a different one of said void spaces of said plurality. The forming step further includes forming a plurality of exterior undercuts from the sheet; each exterior undercut is delimited by a surface of a different respective one of said plurality of receptacles, and a different respective surface portion of said support. The surfaces are seamless with each other. Preferably each exterior undercut is delimited by a connecting surface. Each connecting surface is adjacent a different one of the respective surfaces of one of the receptacles and adjacent a different one of the respective surface portions of said support. The connecting surface is curved and seamless with both the adjacent receptacle surface and support surface. The undercut forming surfaces delimit a pocket. The forming step further includes forming a plurality of other undercuts from the sheet, each other undercut is delimited by one of the void space delimiting surfaces of one of said plurality of compartments and a different surface portion of said support; it is also preferably delimited by a surface delimiting one of said fill entries. The fill entry delimiting surface is curved and is adjacent the void space delimiting surface and support surface. The fill entry surface is seamless with the void space delimiting surface and the support surface; the void space delimiting surface and the support surface are seamless with each other. The package once formed is filled as described above. At least one fill entry has a width measured along its minor axis which is equal to or less than 85% of the width of its respective compartment wherein the width of the compartment is measured along the compartment's minor axis. Also the at least one fill entry has a length measured along its major axis that is equal to or less than 95% of the length of the respective compartment wherein the length is measured along the compartment's major axis. The percentages for the width could be much less such as less than or equal 25%. It could be as little as 0% if the fill entry has a normally closed position. The percentage for the length could be less than or equal to 85%. Each compartment's void space has a volume from 0.7 ml to 4 ml. Each void space delimiting surface follows an outline of a separate 3D pill shape.

DETAILED DESCRIPTION

Figure 1:
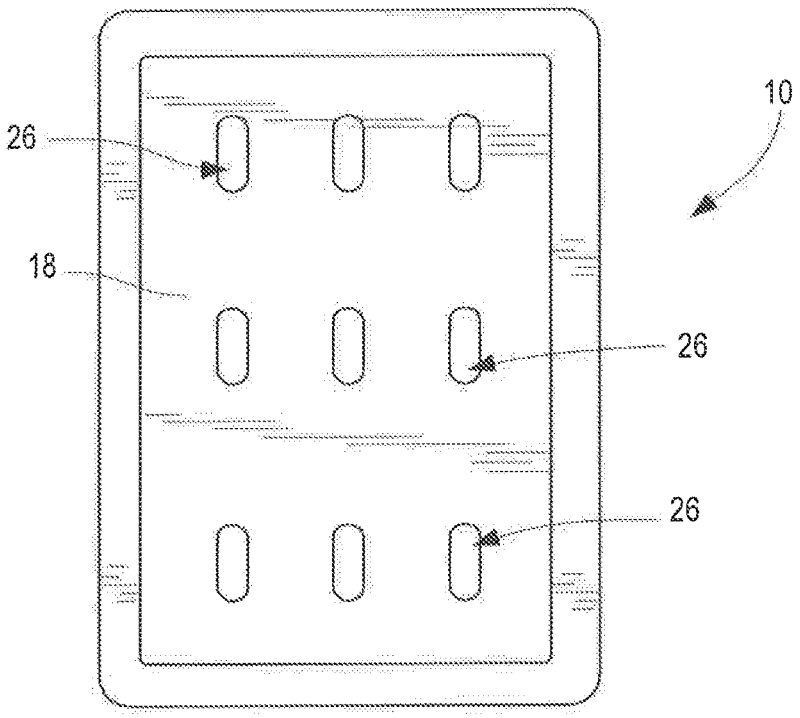
FIG. 1 is a top view of a package embodying features of the present invention.

An embodiment of the present invention comprises a package 10. The package further includes a plurality of compartments 20. The plurality of compartments can be an array of compartments as shown. Each of the compartments 20 is coupled together. A support 18 couples each compartment together. Each of the plurality of compartments forms part of a different one of a plurality of receptacles 34. The receptacles could be directly coupled together without a support. Each compartment 20 is seamlessly coupled to the support 18. Each compartment 20 is seamless and the support 18 is also seamless. Each receptacle is seamless. Each receptacle is seamlessly coupled to the support. The package 16 is seamless. The support 18 and compartments 20 are a mono-block construction. The support 18 and/or the compartments 20 and/or receptacles are flexible and preferably elastomeric. They can be an elastic material such as, silicone, rubber, Ethylene vinyl acetate (EVA) or a composite having elastic and non-elastic material. Each compartment 20 has a respective void space 22 and a respective void space delimiting surface 24. There is a plurality of such surfaces 24. The surfaces 24 are internal surfaces of the package 10. Each delimiting surface 24 has a configuration which follows a 3D outline of a pill shape, such as a tablet, capsule, or caplet shape. Preferably each surface 24 outlines, expect for any area encompassed by a fill entry 26 or fill exit 56, an entire 3D pill shape such as a tablet, capsule, or caplet. In the shown example the delimiting surface 24 of each void space 22 outlines an entire capsule, expect for any area encompassed by a fill entry 26 or fill exit 56. The shape outlined can take any form suitable to be swallowed by a person. In general the void space 22 should have a volume of between 0.7 ml to 4 ml; preferably for a liquid nutrient to be frozen it should be at least 2 ml. The term fluent as used herein is broad enough to include fluid mixed with solids such as a slurry. Fluent is also broad enough to include emulsification. It is also broad enough to include liquid. In general the fluent should have viscosity of no greater than 10,000 centipoise (cP). It could be around 50-500 cP and as little as 0 Cp.

Each receptacle 34 has an external surface 33*a*, 33*b* and the delimiting surface from a respective different one of said plurality of delimiting surfaces 24. Each external surface includes a planar portion 33*a* and 3D portion 33*b* following a 3D outline of a pill.

Each compartment 20 has a different respective fill entry 26 to fill the compartment 20 with a fluent material which is later frozen. Thus there are a plurality of fill entries 26. Each fill entry 26 provides a different one of said compartments 20 with an entry through which fluent is received. The fluent material in the present example is a slurry of various nutrients such as leafy or chlorophyll, rich greens and, or berries and these nutrients may be blended with water. The fluent may be medicinal such as for diabetes.

Figure 2:
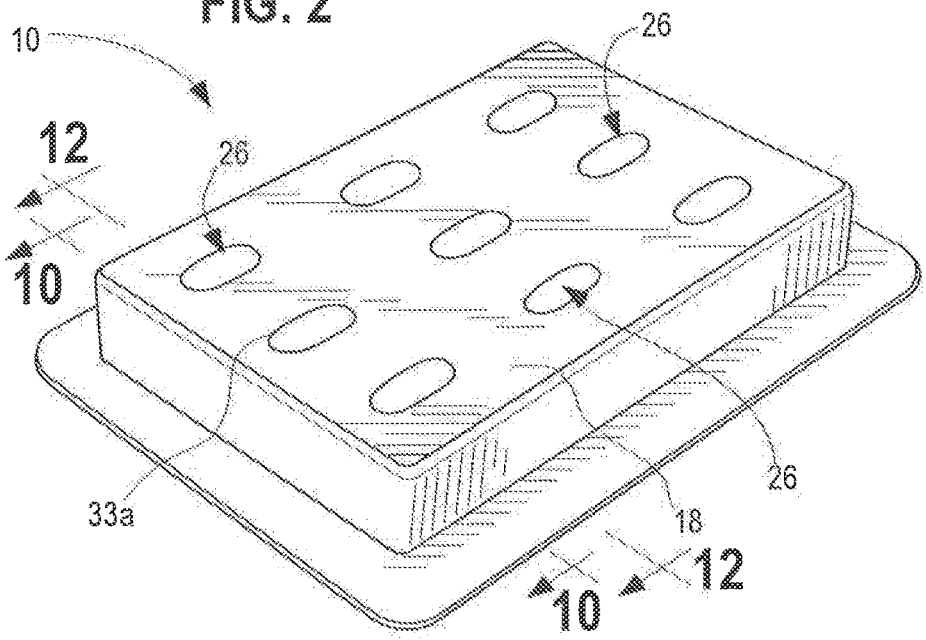
FIG. 2 is a top oriented isometric view of the package of FIG. 1.
Figure 3:
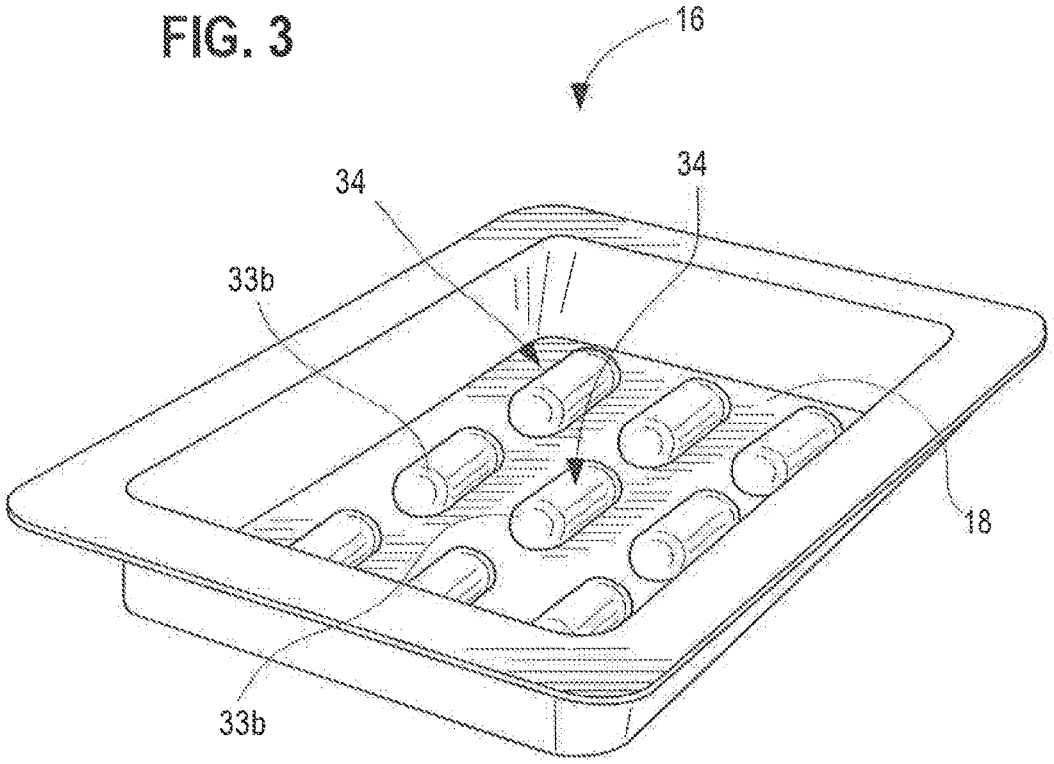
FIG. 3 is a bottom orientated isometric view of the package of FIG. 1.
Figure 4:
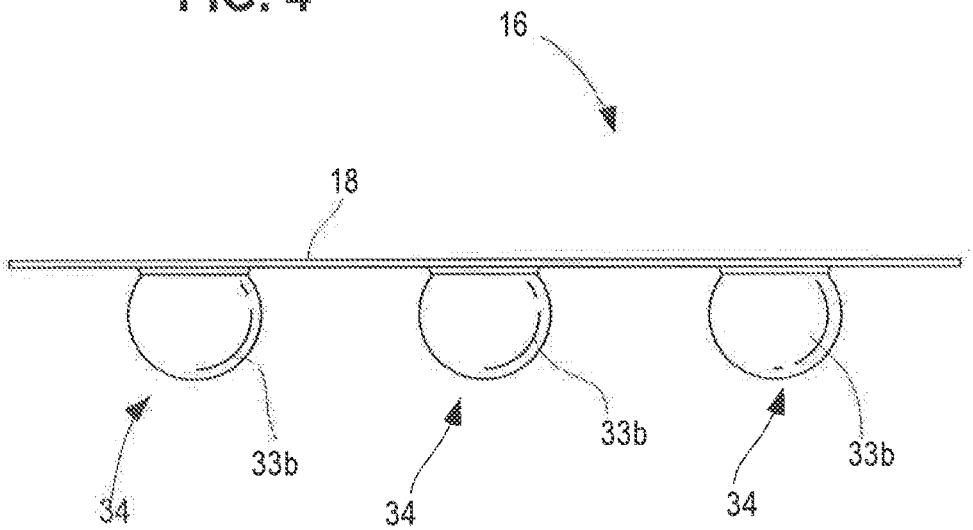
FIG. 4 is an end view of the packaging of FIG. 1 with sidewall and flange removed.
Figure 5:
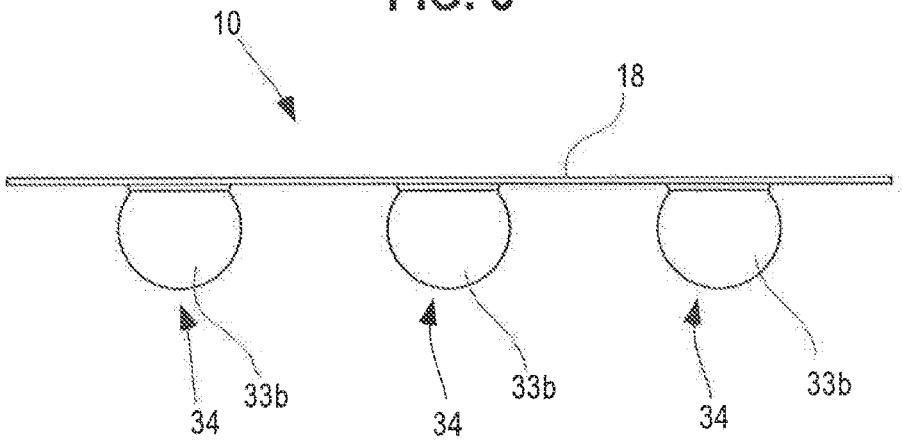
FIG. 5 is an end view opposite the end view of the package shown in FIG. 4 with the sidewall and flange removed.
Figure 6:
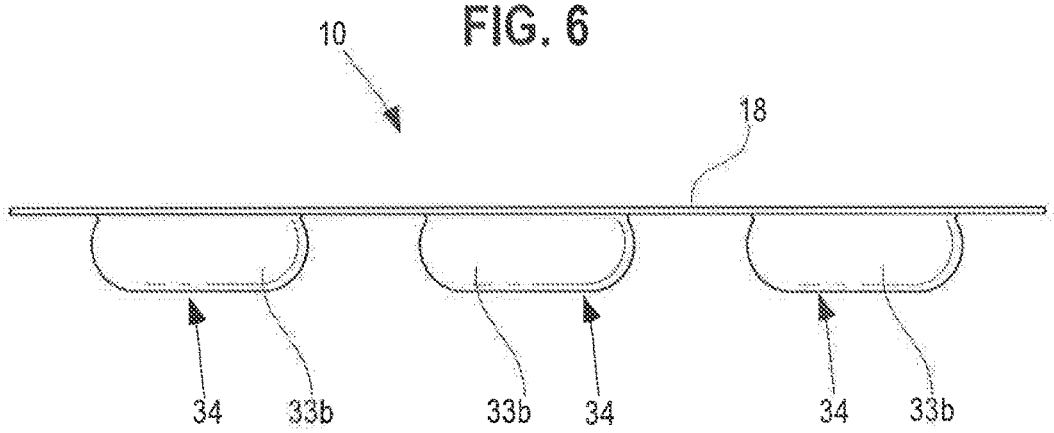
FIG. 6 is a side view of the package of FIG. 1 with sidewall and flange removed.
Figure 7:
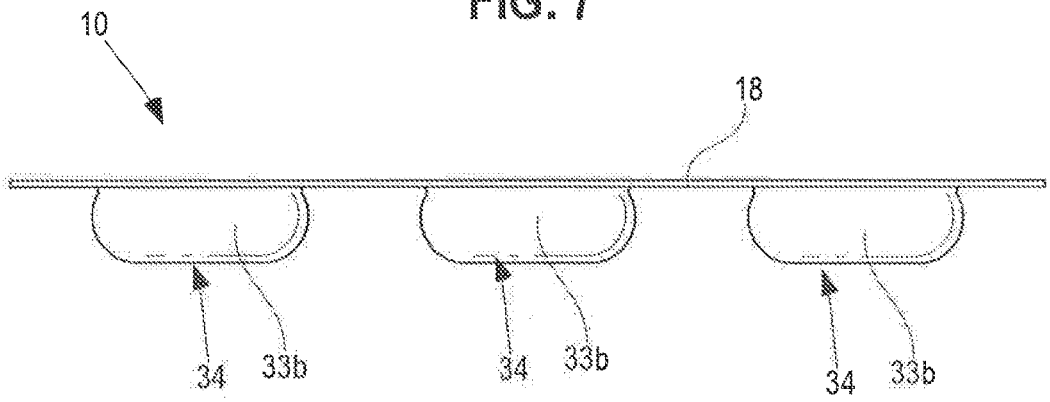
FIG. 7 is a side view opposite the side view of the package of FIG. 7.
Figure 8:
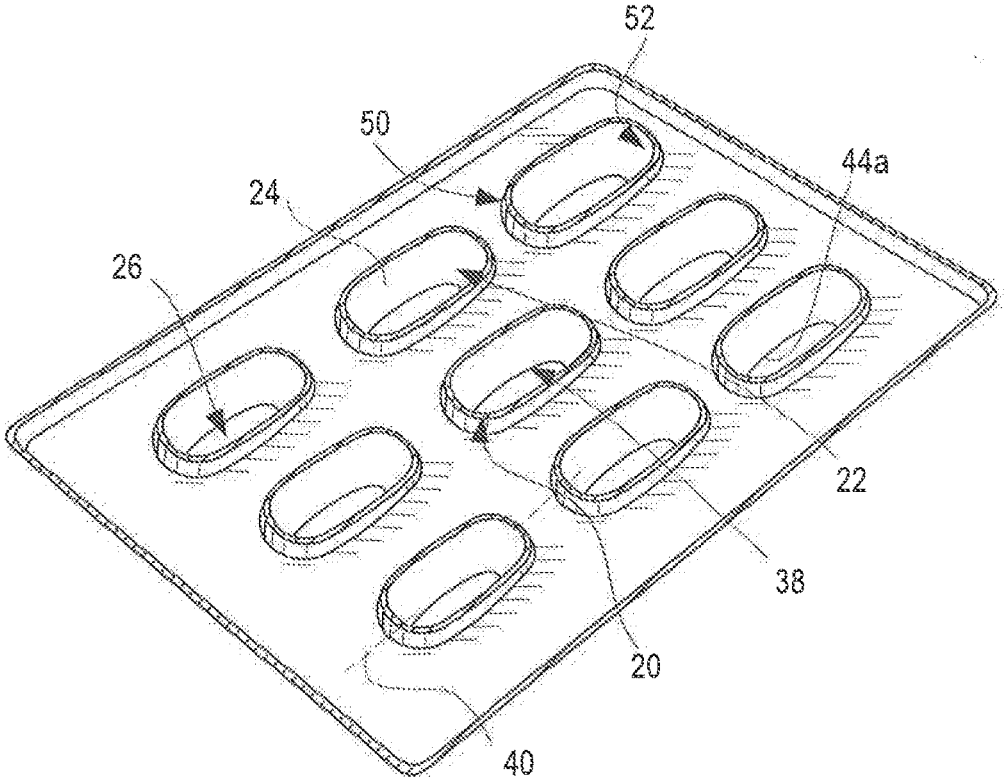
FIG. 8 is a sectional view of the package shown in FIG. 1 taken along view line 8-8 of FIG. 7.
Figure 9:
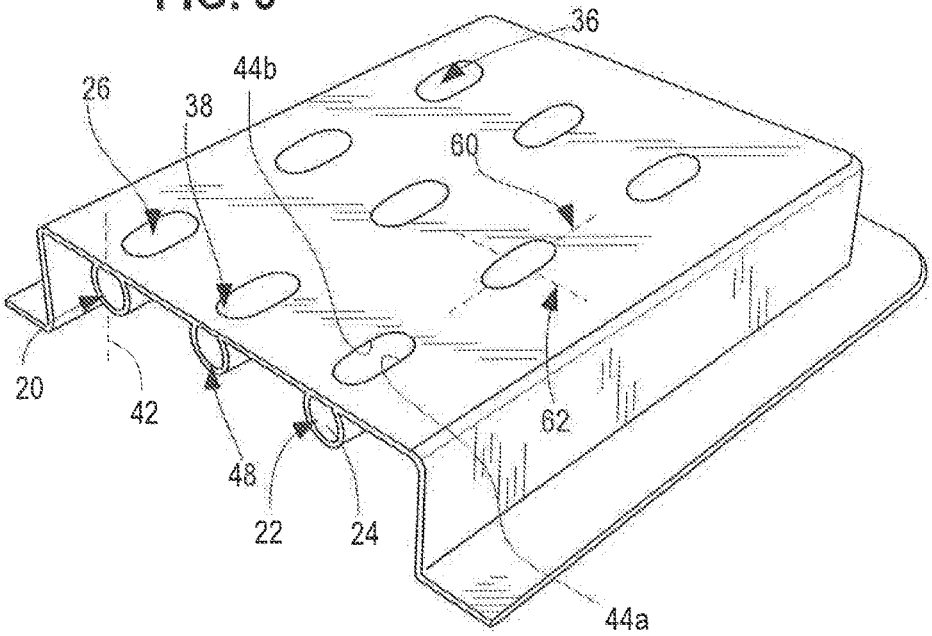
FIG. 9 is a sectional view of the package shown in FIG. 2 taken along view lines 9-9.
Figure 10:
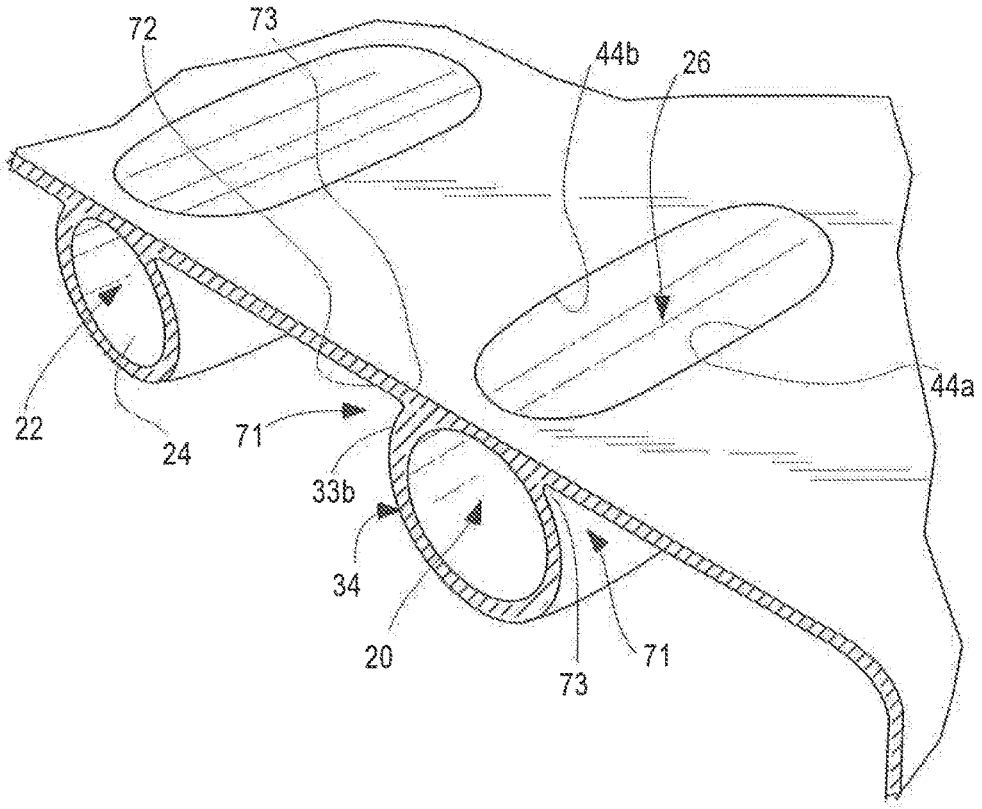
FIG. 10 is a close up of the sectional view shown in FIG. 9.
Figure 11:
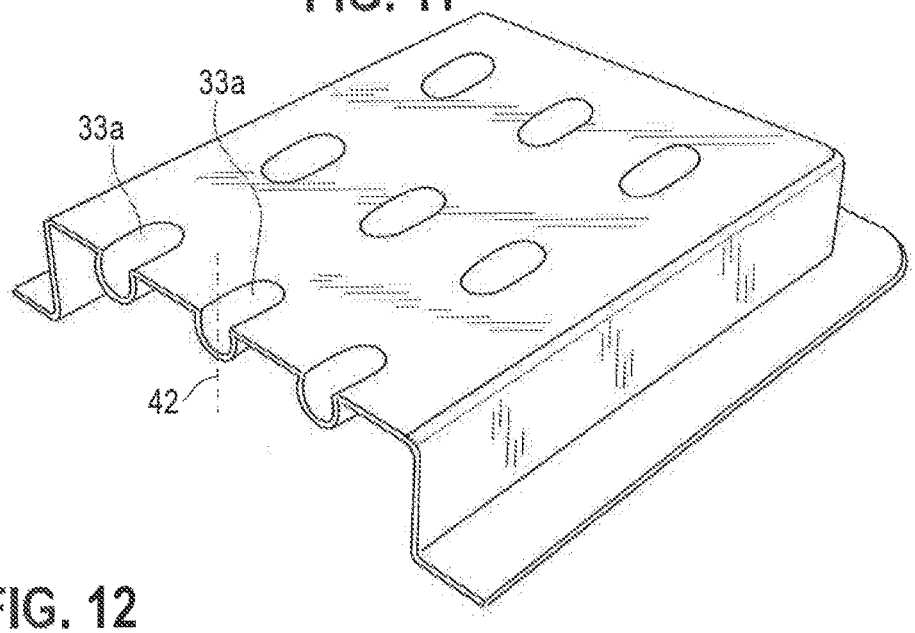
FIG. 11 is a sectional view of the package shown in FIG. 2 taken along view lines 11-11.
Figure 12:
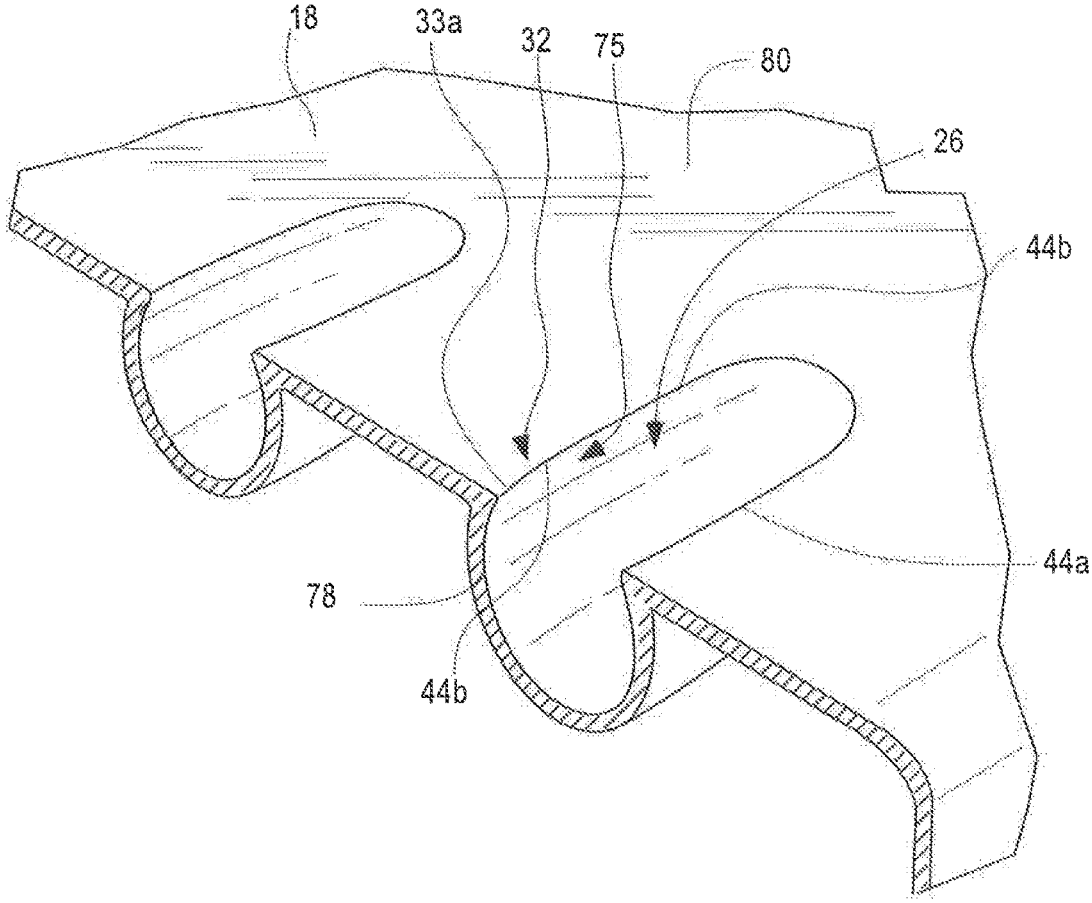
FIG. 12 is a close up of the sectional view shown in FIG. 11.

In the shown example of FIGS. 1, 2 and 4, each fill entry 26 comprises an elongated gap which opens through the compartment's delimiting surface 24 and the planar external surface 33*a* of the receptacle of which the compartment form's a part. The portion of the delimiting surface 24 through which the gap opens is at the first end portion 38 of the compartment 20. The gap 36 is elongated along the direction of the compartment's major axis 40. The gap and fill entry has a width measured in the direction of the compartment's minor axis 42 (which is also the direction of the fill entry's minor axis) and is the distance between oppositely facing surfaces 44*a*, 44*b* delimiting the fill entry 26. The width is no more than 85% of the width of the compartment measured along the compartment's minor axis 42. The percentage could be less than or equal to 25%. Preferably with a thick form process it is no more than 9% of the width of the compartment. The gap and fill entry has a length measured in the direction of the compartment's major axis 40 (which is also the direction of the fill entry's major axis). The length is no more than 95% of the length of the compartment measured along the compartment's major axis 40. The percentage could be less than or equal to 85% Although each fill entry 26 is shown as a gap it could simply be a slit which opens through the planar external surface 33*a* of the receptacle 34 and the portion of delimiting surface 24 of the compartment forming the receptacle. The slit would have a closed position wherein the opposite facing surfaces 44*a*, 44*b* are in contact with each other and an open position wherein at least a portion of the opposite facing surfaces 44*a* 44*b* do not contact each other. In the shown embodiment in FIGS. 1, 2 and 4 each fill entry 26 is only in fluid connection with a different one of each compartment 20.

As stated, each compartment 20 has a first end portion 38 at an end (top) of the compartment along the compartments minor axis 42 which is a first axis. Each compartment also has a second end 48 portion (bottom) along the first axis opposite the compartment's first end portion. Each compartment has a third end portion 50 along the major axis 40 which is a second axis. Each compartment has a fourth end portion 52 opposite its third end and along its second axis.

FIGS. 9 through 18 disclose a packaging 210 having a plurality of fill entries 226 in fluid connection with each other. The packaging is similar to packing 10. A major difference between package 10 and package 210 is that the fill entries 226 and compartments 220 are configured to be in fluid connection as described below. Features in package 210 similar to package 10 are labeled with the same number except a "2" is added as a prefix for each similar item found in packaging 210. Thus fill entries in packaging 210 are listed as 226 as opposed to 26. Many similar features are labeled but not called out. Some similar features are not labeled. Entries 226 are in fluid connection with each other and are along and part of a fluid path 54. The fluid path 54 is unbroken from end to end. The path could be a continuous loop. The packaging 210 also has a plurality of compartments 220 in fluid connection with each other. The fluid path 54 also comprises these compartments. The fluid path also comprises a fluid exit 56 at each compartment. The exits 56 are in fluid connection with each other. The fluid path 54 also comprises fluid connectors 58 fluidly connecting compartments 220 of the fluid path 54. Each fluid connector 58 connects a different one of a pair of compartments 220 which form the fluid path 54. In the shown example at least one of the compartments 220 is a primary compartment 220' and one of the fill entries is a primary fill entry 226'. The primary fill entry 226' is the fill entry for the primary compartment 220'. The primary fill entry 226' and primary compartment 220' are the entry and compartment making up the fluid path 54 of which no other fill entry 226 or compartment 220 is upstream. The primary fill entry opens through an external surface of the package. The primary fill entry 226' is the fluid entry through which all fluent flows in the fluid path 54. It flows through the primary entry 226' first. It flows through the primary entry before flowing to any other to any fill entries 226 in the fluid path 54. The primary compartment 220' is the compartment through which all fluent flows in the path 54. The primary entry and primary compartment are the first to receive fluent disposed in the packaging 210 relative to all other fill entries 226 and compartments 220 making up the fluid path 54.

Figure 13:
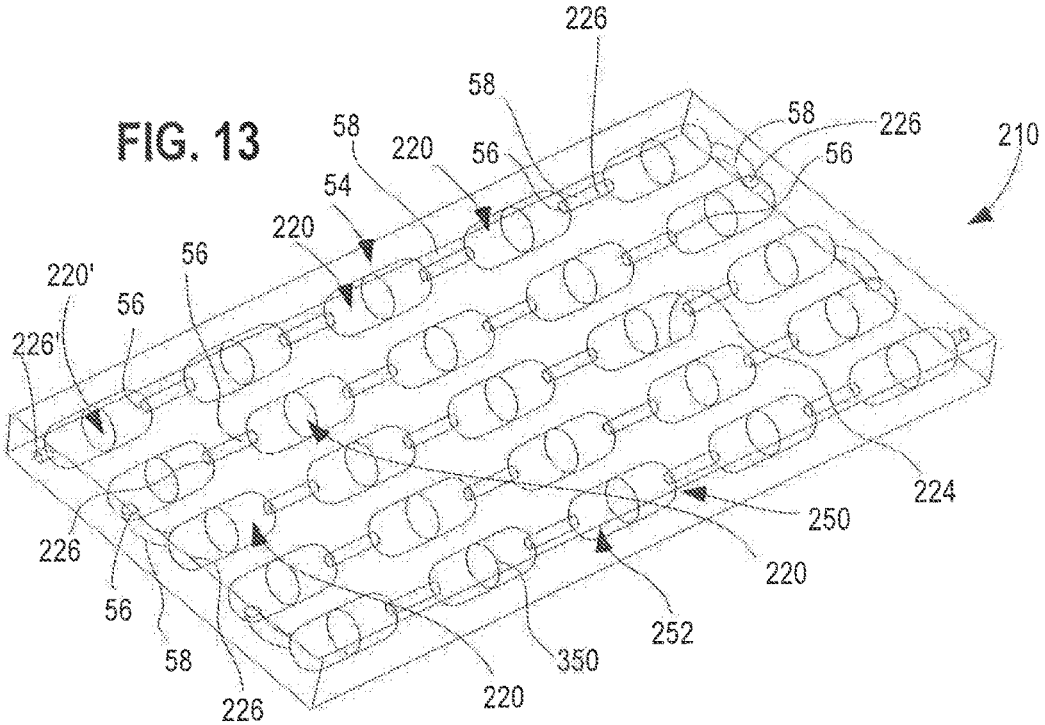
FIG. 13 is a top oriented isometric view of a package which encompasses an alternative embodiment invention showing fill entries and compartments in fluid connection with each other.
Figure 14:
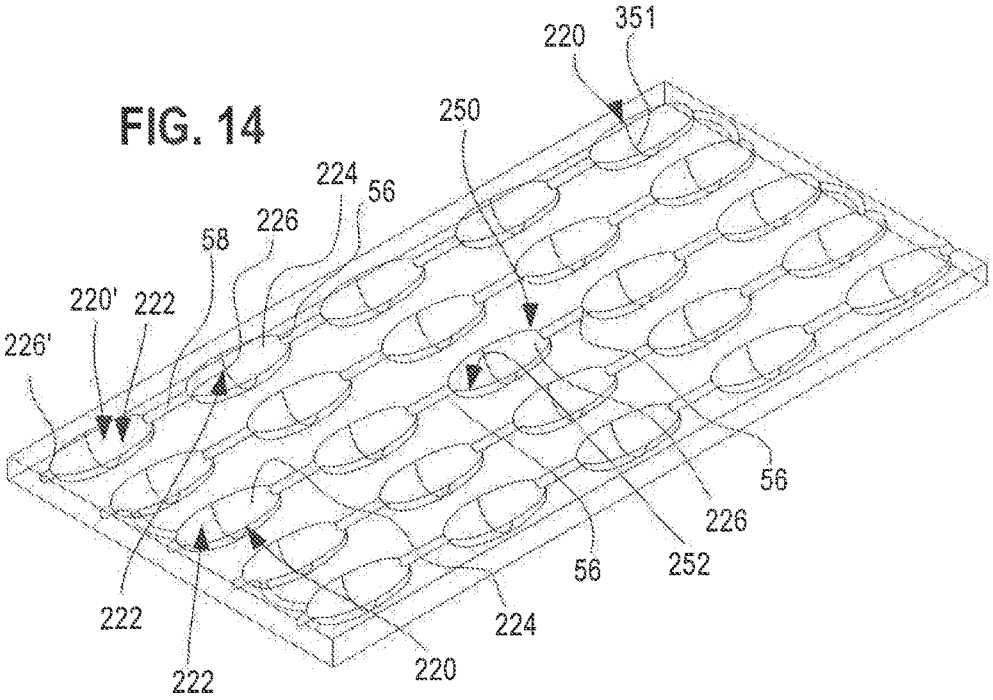
FIG. 14 is a top oriented sectional view of the package shown in FIG. 13 taken along view lines 13-13.
Figure 15:
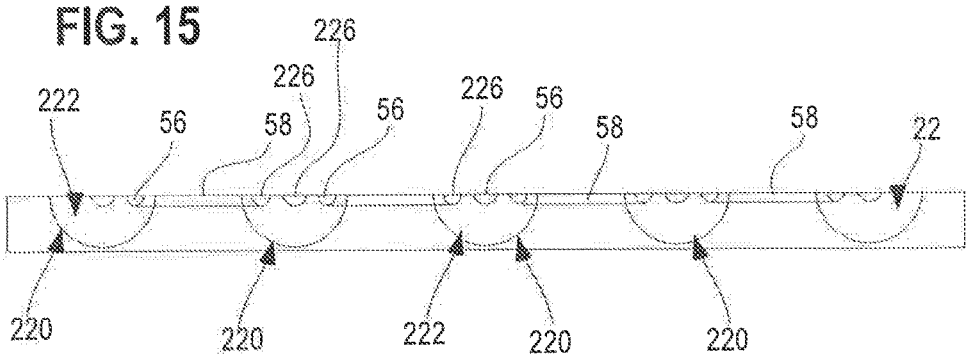
FIG. 15 is an end view of the section shown in FIG. 14.
Figure 16:
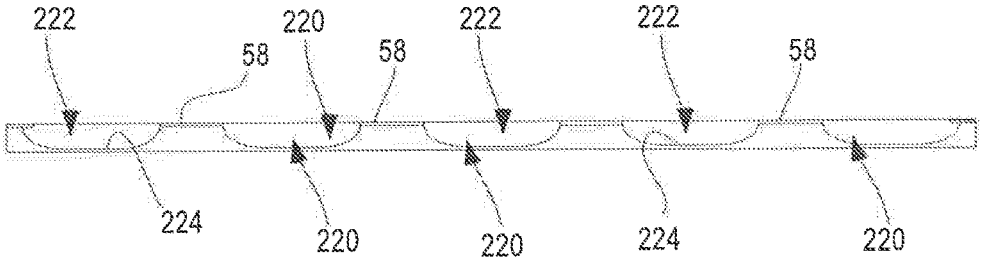
FIG. 16 is a side view of the section shown in FIG. 14.
Figure 17:
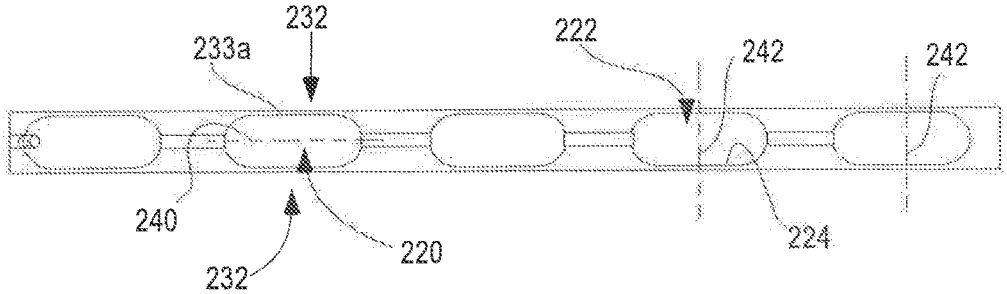
FIG. 17 is a side view of the package shown in FIG. 13.
Figure 18:
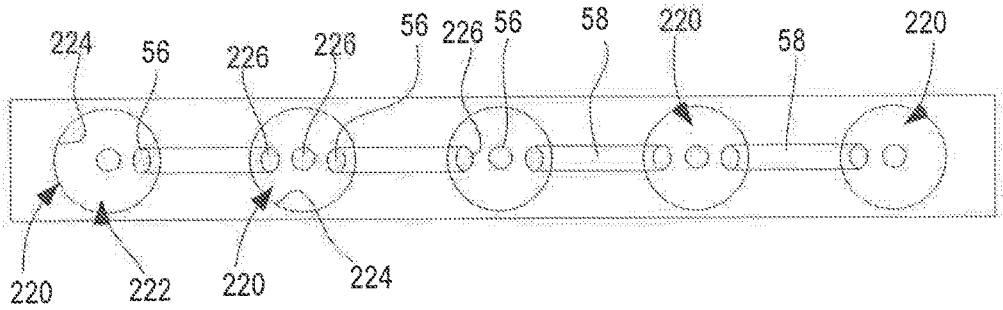
FIG. 18 is an end view of the package shown in FIG. 13.

In the embodiment shown in FIGS. 9-18 each compartment 220, 220' has a different one of said plurality of fill entries 226,226'. Each compartment 220,220' has a different one of said plurality of fluid exits 56. Each fill entry 226, 226' of a compartment is at the compartment's third end 250. Each fluid exit of a compartment 220', 220 is at the compartment's fourth end 252. Each fluid connector 58 is at and in fluid connection with a different one of said fluid exits 56. It is also at and in fluid connection with a different one of said fill entries 226. Reference 350 and 351 in FIGS. 13 and 14 are pointing to contour lines and are not seams.

The fill entries 26; 226, 226' in either embodiment can take on a variety of configurations such as a simple through hole. A fill entry having a width along its minor axis such as 62 and a length along its major axis such as 60 should have a fill entry with a width measured along its minor axis which is equal to or less than 85% of the width of its respective compartment wherein the width of the compartment is measured along the compartment's minor axis. Also the at least one fill entry should have a length measured along its major axis 60 that is equal to or less than 95% of the length of the respective compartment wherein the length is measured along the compartment's major axis. The percentages for the width could be much less such as less than or equal to 25%. The percentages of the length could be less such as less than or equal to 85%.

Notably the fill entry could have a largest sectional area which is equal to or less than 25% of the largest sectional area of its compartment 20; 220, 220' if a thin form process is used and equal to or less than 7% if a thick form process is used. The largest sectional area of the fill entry could be between 55% to 75% of the largest sectional area of the compartment. The sectional area of the fill entry should be measured along a cross section taken along and parallel to a first or second axis of the fill entry 26; 226, 226'. The first and second axis should be perpendicular and intersect. The axis chosen should be the axis on which the length of the fill entry 26; 226, 226' is the greatest. If no length is greatest than either axis may be chosen. In the shown embodiment the first axis 60 is chosen over the second axis 62. Likewise the cross sectional area of the compartment should be taken along the compartment's 20; 220, 220' first 42; 242 or second axis 40; 240. The first and second axis of each compartment are perpendicular to each other and intersect with each other. The axis chosen should be the axis along which the length of the compartment is greatest. If no length is greatest than either axis may be chosen. In the shown embodiment in FIG. 4 the second axis 40 is the major axis and is chosen.

To make a package containing frozen nutrient pills, the package 10; 210 is provided. The package 10; 210 has a plurality of the compartments 20; 220, 220' and fill entries 26; 226, 226'. Each compartment 20; 220, 220' of said plurality has a different respective one of said plurality of fill entries 26; 226, 226'. Each compartment 20; 220, 220' has a delimiting surface 24; 224, each delimiting surface of a compartment 20; 220, 220' outlines a 3D pill shape.

Fluent nutrient is flowed into each of the plurality of compartments 20; 220, 220' through the compartment's respective fill entry 26; 226, 226'. A fluent dispenser, such as an auto-pipette or mechanical pipette that can transfer measured amounts of a liquid automatically, can be used to flow the fluent.

In one method, each fill entry 26 of the plurality of fill entries 26 is only in fluid connection with a different one of said plurality of compartments 20. Each fill entry 26 is fluidly sealed off from each of the other fill entries 26. Each compartment 20 is fluidly sealed off from each of the other compartments 20. To fill the compartments under this method, a portion of a fluent dispenser is disposed through each fill entry 26. The portion disposed in each fill entry is a slurry. The fluent flows into each compartment from the dispenser.

In another embodiment, the fill entries 226, 226' are in fluid connection with each other and one of the entries is a primary fill entry 226'. The compartments 220, 220' are also in fluid connection with each other, and one of the compartments is a primary compartment 220'. In this embodiment fluent flows through primary fill entry 226' and then from the primary entry 226' to fill entries 226 of said plurality downstream of said primary entry 226'. Also, fluid flows from the primary compartment 220' to compartments 220 downstream of the primary compartment.

The packaging with the nutrient is placed in a bag which is sealed. Alternatively a sheet is sealed to the top surface 80 of the packaging to cover the partition surfaces 33*a* and the fill entries 26. The fluent in the packaging is frozen after the compartments are filled with fluent. The fluent nutrient has a freezing point of from −3 c to −4 c and storage at −18 C.

A person ingests the nutrient as a frozen pill by popping the pill through a pill exit. Each compartment has a pill exit. The pill exit could be the gap 36. It could be the slit, or it could be some other part of a partition portion 32; 232 of the package 10; 210. In this example the frozen pill is a frozen capsule. The frozen pill could also be a frozen tablet. It could also have a caplet shape. The pill exit is a capsule exit when a capsule is formed.

Figure 19:
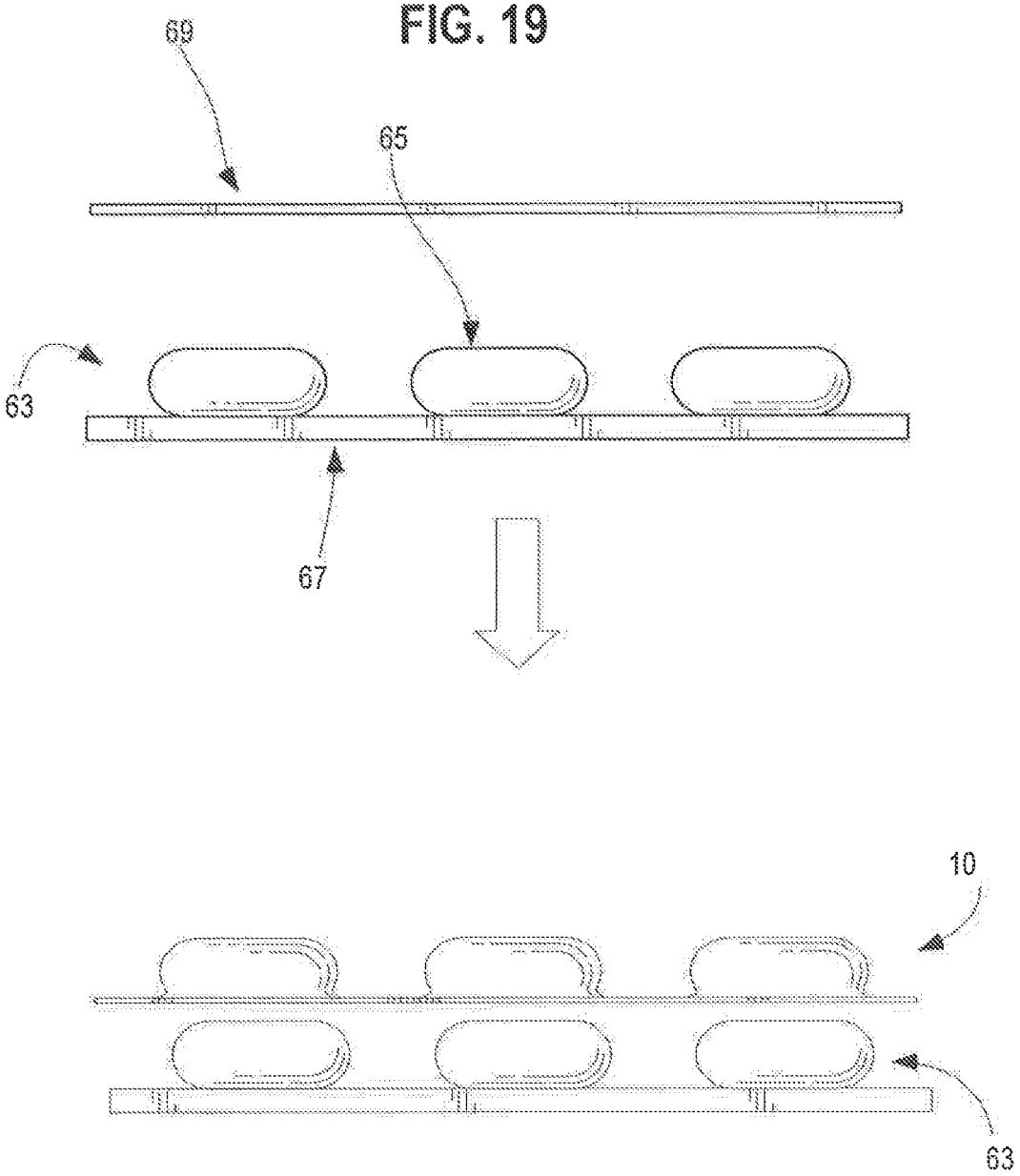
FIG. 19 is an exploded view of a form and a thin sheet capable of making packaging which embodies the invention.

One example of a method of making the package 10 includes providing a form 63. The form is preferably a vacuum enabled form. The form provides a negative of the shape of the package to be formed. The form includes a plurality of pill compartment forming portions 65; each following an outline of a pill. The form also includes a load bearing support 67. The load bearing support bears a load of the plurality of the pill compartment form portions 65. Each pill compartment form portion is carried by the support 67. The method further includes contacting a thin elastic sheet 69 preferably made from silicone or rubber to the load bearing support 67 and pill forming portions 65. The method further includes forming the plurality of receptacles 34 coupled to the support 18 from the thin elastic sheet 69 with negative pressure when the sheet 69 is in contact with the load bearing support 67 and pill compartment form portions 65. The forming step further includes forming the plurality of compartments 20 from the sheet 69, each compartment 20 having a different respective void space 22 and a different respective void space delimiting surface 24; each compartment forming part of a different respective one of said receptacles 34. The forming step further includes forming a plurality of fill entries 26 from the sheet 69; a different fill entry 26 of said plurality, opens into a void space 22 of a different respective one said compartments 20. The forming step further includes forming a plurality of exterior undercuts 71 from the sheet; each exterior undercut is delimited by a portion of external surface 33*b* of a different respective one of said plurality of receptacles 34, and a different respective surface portion 72 of said support 18. The surfaces 72, 33*b* are seamless with each other. Preferably each exterior undercut is delimited by a connecting surface 73. Each connecting surface 73 is adjacent one of the different respective surfaces 33*b* of one of the different receptacles 34 and adjacent one of the different respective surface portions 72. The connecting surface 73 is curved and seamless with both the adjacent receptacle surface 33*b* and support surface 72. The undercut forming surfaces delimit a pocket. The forming step further includes forming a plurality of other undercuts 75 from the sheet 69, each other undercut is delimited by a portion 78 of a void space delimiting surface 24 of a different one of said plurality of compartments 20 and surface 33*a* of partition 32; it is also preferably delimited by surfaces 44*a*, 44*b* delimiting a different one of said fill entries. The fill entry delimiting surfaces 44*a*, 44*b* are curved and are adjacent the void space delimiting surface 78 and support surface 33*a*. The fill entry surface 44*a*, 44*b* is seamless with the void space delimiting surface 78 and the support surface 33*a*; the void space delimiting surface 78 and the support surface 33*a* are seamless with each other. The package once formed is filled with fluent as described above. At least one fill entry of said packaging has a width which is at least equal to or less than 85% of the width of the compartment. Each compartment's void space has a volume from 0.7 ml to 4 ml. Each void space delimiting surface follows an outline of a separate 3D pill shape. Other methods of making the package include applying the material to a form by spraying, brushing, pouring and injection molding as opposed to using a preformed sheet and vacuum form as in FIG. 19.

The invention claimed is:

1. A package comprising:

a plurality of seamless compartments coupled together;

a different one of said plurality of compartments each including a different respective one of a plurality of respective void spaces and each including a different respective one of one of a plurality of respective void space delimiting surfaces;

a plurality of fill entries, a different one of each said fill entries of said plurality forms a fluent entry into a different one of each of said compartment's respective void space;

a plurality of receptacles, a different one of said plurality of receptacles each include a respective different one of said plurality of void space delimiting surfaces and an external surface, said external surface of each receptacle including a curvilinear portion, the entirety of the curvilinear portion on one side of a support which couples the receptacles together;

wherein at least one fill entry of said plurality forming the fluent entry in one of said compartment's void space is in an elastomeric portion of said package, and said at least one fill entry has a width measured along its minor axis or a diameter which is less than the width of the of the compartment having the at least one fill entry forming the fluent entry into the compartment's void space, wherein the width of the compartment is measured along the compartments minor axis;

wherein each compartment of said plurality has a volume from 0.7 ml to 4 ml; and wherein each void space delimiting surface of said plurality follows an outline of a separate 3D pill shape; and wherein each of said fill entries of said plurality of said fill entries circumscribes a different one of said void space delimiting surfaces.

2. The package of claim 1 wherein:

a different one of said plurality of fill entries opens through each of said receptacle's external surface and its void space delimiting surface.

3. The package of claim 2 wherein:

each compartment is fluidly separated from each of the other of said plurality of compartments.

4. The package of claim 2 wherein:

each compartment is in fluid connection with each of the other of said plurality of compartments.

5. A package comprising:

a plurality of seamless compartments coupled together along a support;

a different one of said plurality of compartments each including a different respective one of a plurality of respective void spaces and each one of said compartments including a different respective one of a plurality of void space delimiting surfaces;

a plurality of fill entries, a different one of each of said fill entries of said plurality forms a fluent entry into a different one of each of said compartment's respective void space, each fill entry is delimited by a pair of fill entry delimiting surfaces;

a plurality of receptacles, a different one of said plurality of receptacles each include a respective different one of said plurality of void space delimiting surfaces and an external surface, said external surface of each receptacle having a curvilinear portion and a planar portion, the entirety of the curvilinear portion on one side of the support and the entirety of the planar portion forming a portion of an opposite side of the support, each compartment forming part of a different one of said receptacles;

a plurality of exterior undercuts, each exterior undercut is delimited by a portion of an external surface of a different respective one of said plurality of receptacles and a different respective surface portion of said support, all of said exterior undercuts oriented on one side of said support, wherein the surfaces are seamless with each other;

wherein each void space delimiting surface of said plurality is adapted to mold fluent received through each fill entry of said plurality of fill entries into a shape for consumption when said fluent is frozen; and wherein each fill entry of said plurality of fill entries circumscribes a different one of said void space delimiting surfaces; and at least one fill entry of said plurality forming the fluent entry into the void space of one of said compartments, is in an elastomeric portion of said package, and said at least one fill entry has a width measured along its minor axis which is less than the width of the compartment having the at least one fill entry forming the fluent entry into the compartment's void space, wherein the width of the compartment is measured along its minor axis.

6. The package of claim 5 wherein each exterior undercut is delimited by a connecting surface, each connecting surface is adjacent one of the different respective external surfaces of one of the different receptacles and adjacent one of the different respective surface portions of said support.

7. The package of claim 6 wherein each connecting surface is curved and seamless with both the adjacent receptacle surface and support surface.

8. The package of claim 7 wherein each of the undercut forming surfaces delimit a pocket.

9. The package of claim 8 further comprising a plurality of other undercuts, each other undercut is delimited by a portion of a void space delimiting surface and a surface of a partition.

10. The package of claim 9 wherein each other undercut is also delimited by the surfaces delimiting a different one of said fill entries.

11. The package of claim 10 wherein the fill entry delimiting surfaces are curved and are adjacent a respective void space delimiting surface and a surface of said partition.

12. The package of claim 11 wherein each compartment of said plurality has a volume from 0.7 ml to 4 ml; and wherein each void space delimiting surface of said plurality follows an outline of a separate 3D pill shape.

* * * * *